US009501966B2

(12) United States Patent
Lee

(10) Patent No.: US 9,501,966 B2
(45) Date of Patent: Nov. 22, 2016

(54) GATE DRIVER WITH MULTIPLE SLOPES FOR PLASMA DISPLAY PANELS

(75) Inventor: Dong Young Lee, Torrance, CA (US)

(73) Assignee: Infineon Technologies Americas Corp., El Segundo, CA (US)

( * ) Notice: Subject to any disclaimer, the term of this patent is extended or adjusted under 35 U.S.C. 154(b) by 552 days.

(21) Appl. No.: 13/022,323

(22) Filed: Feb. 7, 2011

(65) Prior Publication Data

US 2012/0200547 A1 Aug. 9, 2012

(51) Int. Cl.

*G09G 3/28* (2013.01)
*G09G 3/292* (2013.01)
*G09G 3/296* (2013.01)

(52) U.S. Cl.

CPC ..... *G09G 3/2927* (2013.01); *G09G 3/296* (2013.01); *G09G 2310/066* (2013.01); *G09G 2330/028* (2013.01)

(58) Field of Classification Search

CPC ..... G09G 3/28; G09G 2330/028
USPC ..... 345/60, 68, 208; 323/288, 326
See application file for complete search history.

(56) References Cited

U.S. PATENT DOCUMENTS

2002/0080097 A1* 6/2002 Tokunaga et al. ..... 345/41
2002/0122016 A1* 9/2002 Iwasa et al. ..... 345/60
2006/0232512 A1* 10/2006 Kim ..... 345/60
2008/0054984 A1 3/2008 Lee
2008/0117125 A1* 5/2008 Song ..... G09G 3/296 345/60
2008/0238825 A1* 10/2008 Kanazawa et al. ..... 345/60
2008/0284683 A1* 11/2008 Lee et al. ..... 345/60
2010/0225671 A1* 9/2010 Makino et al. ..... 345/690
2010/0321363 A1* 12/2010 Morita et al. ..... 345/211

FOREIGN PATENT DOCUMENTS

JP 2002196720 A * 7/2002
WO WO 2009001529 A1 * 12/2008

* cited by examiner

*Primary Examiner* — Amare Mengistu
*Assistant Examiner* — Stacy Khoo
(74) *Attorney, Agent, or Firm* — Slater Matsil, LLP

(57) ABSTRACT

According to an exemplary embodiment, a driver circuit for generating a reset pulse of an output waveform includes a plurality of ramp paths, each ramp path being configured to control the slope of the reset pulse. The driver circuit also includes a falling switch configured to selectively hold the output waveform low. The driver circuit further includes a switch controller for selectively enabling the plurality of ramp paths and the falling switch to generate the reset pulse. The switch controller can selectively enable the plurality of ramp paths responsive to a reference setting signal to select the slope of the reset pulse. The driver circuit can also generate a sustain pulse. The driver circuit is can generate the reset pulse and the sustain pulse by driving a transistor.

17 Claims, 4 Drawing Sheets

GATE DRIVER WITH MULTIPLE SLOPES FOR PLASMA DISPLAY PANELS

BACKGROUND OF THE INVENTION

1. Field of the Invention

The present invention is generally in the field of electrical circuits. More particularly, the invention relates to driver circuits for use in plasma display panels.

2. Background Art

A Plasma Display Panel (PDP) uses plasma generated by a plurality of discharge cells to generate images. Each discharge cell typically includes an address electrode and first and second discharge electrodes (X and Y electrodes) between which a voltage is applied during operation of the PDP. The operation of the PDP is generally divided into frames of time, where the discharge cells are driven by controlling the electrodes during multiple reset periods, address periods, and sustain periods. For example, during reset and sustain periods one of the discharge electrodes can be driven by a voltage waveform including respective reset and sustain pulses. The reset pulse can comprise a slow sloping voltage while the sustain pulse can comprise a fast switching voltage. In various applications it may be desirable to allow for selection amongst multiple selectable slopes for the reset pulse.

In conventional PDPs, multiple slopes for the reset pulse have been implemented using separate general gate drivers for each particular reset pulse. Each general gate driver typically includes series connected switches configured to drive a transistor to implement the reset pulse. A respective resistor can be connected to each of the general gate drivers to set the slope of the reset pulse provided by the general gate driver and a capacitor can be connected across the gate and drain of the transistor. A separate general gate driver is also used to implement a sustain pulse as well as a separate transistor. Each general gate driver is contained within a separate integrated circuit (IC). In view of the foregoing, among other disadvantages, conventional approaches introduce substantial cost and consume a large amount of PCB space.

SUMMARY OF THE INVENTION

A gate driver with multiple slopes for plasma display panels, substantially as shown in and/or described in connection with at least one of the figures, as set forth more completely in the claims.

DETAILED DESCRIPTION OF THE INVENTION

The present invention is directed to a gate driver with multiple slopes for plasma display panels. The following description contains specific information pertaining to the implementation of the present invention. One skilled in the art will recognize that the present invention may be implemented in a manner different from that specifically discussed in the present application. Moreover, some of the specific details of the invention are not discussed in order to not obscure the invention. The specific details not described in the present application are within the knowledge of a person of ordinary skill in the art.

The drawings in the present application and their accompanying detailed description are directed to merely exemplary embodiments of the invention. To maintain brevity, other embodiments of the invention, which use the principles of the present invention, are not specifically described in the present application and are not specifically illustrated by the present drawings.

Figure 1:
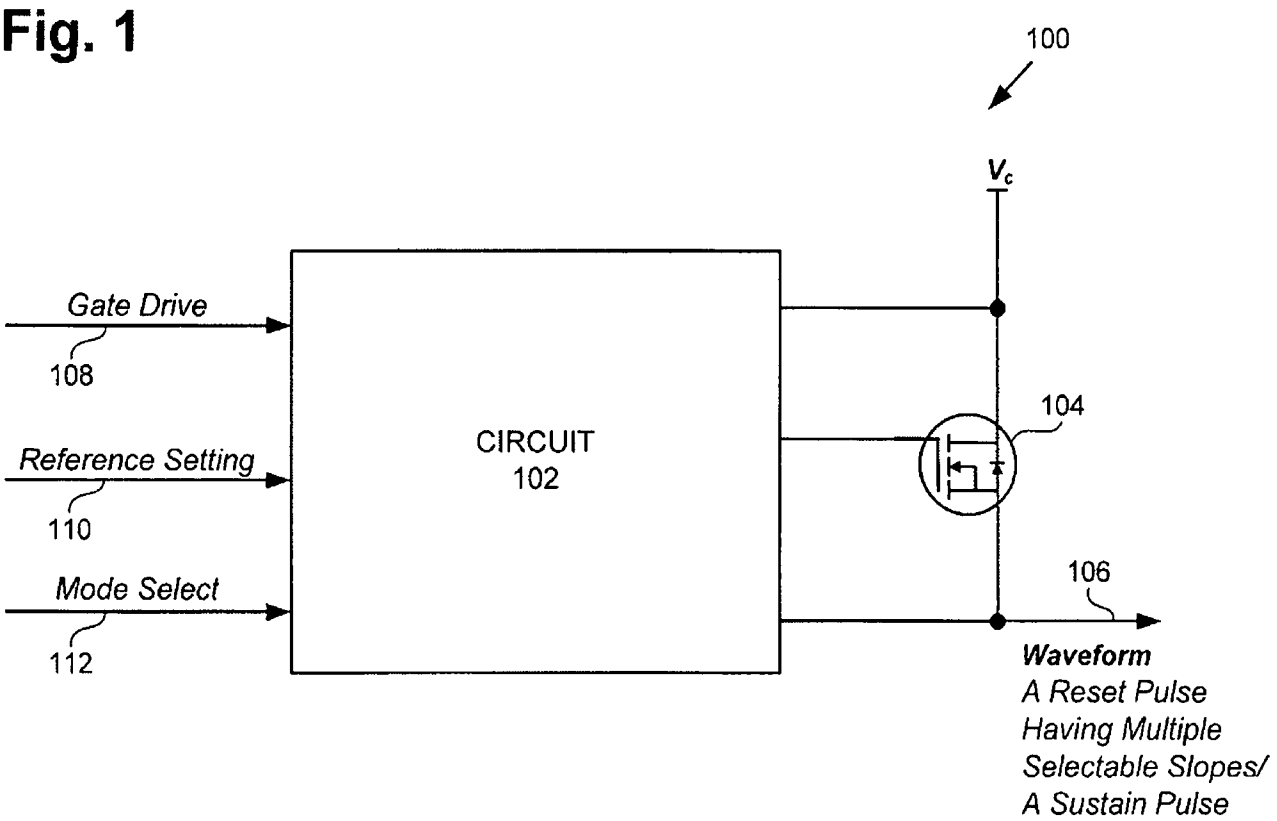
FIG. 1 illustrates an exemplary circuit for generating an output waveform including a reset pulse, according to one embodiment of the present invention.

FIG. 1 illustrates an exemplary circuit for generating output waveform 106 including a reset pulse. Waveform generator circuit 100 includes circuit 102 for generating the reset pulse of output waveform 106. In the embodiment shown in FIG. 1, circuit 102 receives gate drive signal 108, reference setting signal 110, and mode select signal 112 to drive transistor 104. In waveform generator circuit 100, circuit 102 drives transistor 104, which can comprise, for example, a MOSFET or IGBT, to generate output waveform 106. Output waveform 106 comprises a voltage waveform and can be provided to control a discharge cell of a plasma display panel (PDP). For example, output waveform 106 can be provided to a discharge electrode of the discharge cell to control the PDP. As an example, output waveform 106 can be provided to the Y electrode of the discharge cell.

In waveform generator circuit 100, circuit 102 comprises a driver circuit for generating the reset pulse having multiple selectable slopes. Thus, for example, during a reset period of a PDP, output waveform 106 can include a sloping or ramping reset pulse having a given slope. The reset pulse can comprise a turn-on reset pulse where high supply voltage $V_C$ comprises a set voltage ($V_{set}$). The reset pulse generally has a slow dV/dt characteristic, which can be, for example, around several V/us. As a specific example, the change in voltage can be around 200-300 volts over 100-300 microseconds.

In waveform generator circuit 100, circuit 102 comprises a driver circuit for generating the reset pulse. For example, circuit 102 can control voltages at the source, drain, and gate of transistor 104 to generate the reset pulse. In the present example, gate drive signal 108 is used to control switches within circuit 102 to drive transistor 104 to generate the reset pulse. Gate drive signal 108 can comprise a square input waveform, where switches in circuit 102 are controlled by an amplifier receiving gate drive signal 108, with at least one switch receiving the inverse of gate drive signal 108.

Circuit 102 further comprises a driver circuit for generating the reset pulse having a selectable slope. Thus, waveform generator circuit 100 can selectively generate the reset pulse having a given slope amongst the multiple slopes that can be generated in output waveform 106. As shown in FIG. 1, circuit 102 receives reference setting signal 110, which can be used to select the given slope for the reset pulse. For example, in one embodiment, reference setting signal 110 can control which switches receive gate drive signal 108 to selectively generate the reset pulse having a given slope.

In some embodiments, in waveform generator circuit 100, circuit 102 can comprise a driver circuit for generating a sustain pulse. Thus, for example, during a sustain period of a PDP, output waveform 106 can include a fast switching pulse. The high supply voltage $V_C$ can comprise a sustain voltage ($V_{sustain}$). As opposed to the reset pulse, the sustain pulse generally has a relatively fast dV/dt characteristic, which can be provided, for example, by hard switching transistor 104. Gate drive signal 108 can also be used to control switches within circuit 102 to drive transistor 104 to generate the sustain pulse in a similar manner as the reset pulse. In some embodiments, waveform generator circuit 100 includes mode select signal 112, which can be used to select between a reset mode where waveform generator circuit 100 generates output waveform 106 with a reset pulse or a sustain mode where waveform generator circuit 100 generates output waveform 106 with a sustain pulse.

Figure 2:
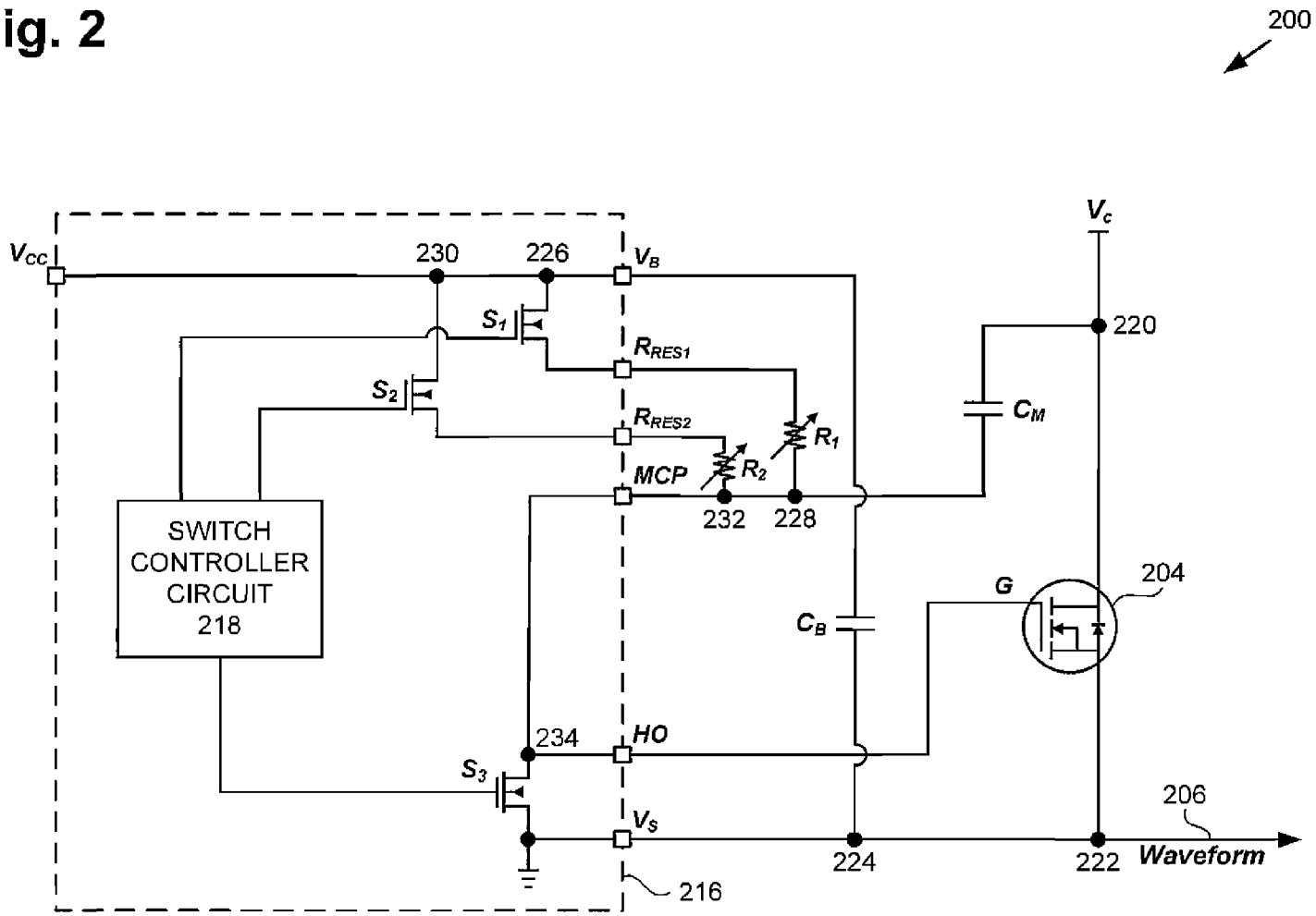
FIG. 2 illustrates an exemplary driver circuit for generating a reset pulse of an output waveform, according to one embodiment of the present invention.

FIG. 2 illustrates waveform generator circuit 200 corresponding to waveform generator circuit 100 in FIG. 1. Waveform generator circuit 200 can generate output waveform 206 corresponding to output waveform 106 in FIG. 1. Waveform generator circuit 200 includes transistor 204 corresponding to transistor 104 in FIG. 1. Waveform generator circuit 200 also includes driver circuit 216, reference resistors $R_1$ and $R_2$, bootstrap capacitor $C_B$ and miller capacitor $C_M$, which can collectively correspond to circuit 102 in FIG. 1. Driver circuit 216 includes switch controller circuit 218 coupled to slope selection switches $S_1$ and $S_2$ and falling switch $S_3$.

In the embodiment shown in FIG. 2, driver circuit 216 is implemented as an integrated circuit (IC) having pins $V_{CC}$, $V_B$, $R_{RES1}$, $R_{RES2}$, MCP, HO, and $V_S$. A low supply voltage, for example, around 15-18 volts, can be provided to $V_{CC}$ pin, which comprises a low voltage supply pin.

In driver circuit 216, switch controller circuit 218 is configured to selectively enable a plurality of ramp paths and falling switch $S_3$ to generate a reset pulse. Each of the plurality of ramp paths is configured to control the slope of the reset pulse. Thus, driver circuit 216 is configured to provide for multiple slopes for the reset pulse in output waveform 206. The given slope of the generated reset pulse depends on which ramp path is selectively enabled along with falling switch $S_3$.

In the present embodiment, driver circuit 216 is configured to generate the reset pulse of output waveform 206 by driving transistor 204. As shown in FIG. 1, transistor 204 is coupled to high voltage supply $V_C$, which can comprise a set voltage ($V_{set}$). More particularly, the drain of transistor 204 is coupled to high voltage supply $V_C$ through node 220. The source of transistor 204 is coupled to ground and driver circuit 216 through $V_S$ pin and gate G of transistor 204 is coupled to driver circuit 216 through HO pin. The source of transistor 204 can further be coupled to an electrode of a discharge cell of a PDP to provide output waveform 206 to the discharge cell. Miller capacitor $C_M$ is coupled between high voltage supply $V_C$ through node 220 and gate G of transistor 204 through MCP pin. Bootstrap capacitor $C_B$ is also provided in waveform generator circuit 200 to provide a stable reset pulse in output waveform 206. As shown in FIG. 2, $V_{CC}$ supply pin is coupled to $V_B$ pin and bootstrap capacitor $C_B$ is coupled to driver circuit 216 through $V_S$ pin at node 224 and through $V_B$ pin.

Also in the present embodiment, switch controller circuit 218 is configured to selectively enable a respective one of the ramp paths using a switch. As shown in FIG. 2, slope selection switch $S_1$ is connected to $V_{CC}$ supply pin through node 226 and to gate G and miller capacitor $C_M$ through node 228. Switch controller circuit 218 can selectively couple node 228 to a low supply voltage from $V_{CC}$ supply pin through reference resistor $R_1$ using slope selection switch $S_1$. Similarly, slope selection switch $S_2$ is connected to $V_{CC}$ supply pin through node 230 and to gate G and miller capacitor $C_M$ through node 232. Switch controller circuit 218 can selectively couple node 232 to the low supply voltage from $V_{CC}$ supply pin through reference resistor $R_2$ using slope selection switch $S_2$. By enabling any of slope selection switches $S_1$ and $S_2$, switch controller circuit 218 can enable a ramp path by connecting any of reference resistors $R_1$ and $R_2$ to the low supply voltage. For example, one ramp path can be enabled by enabling slope selection switch $S_1$ while slope selection switch $S_2$ is disabled. Another ramp path can be enabled by enabling slope selection switch $S_2$ while slope selection switch $S_1$ is disabled. Thus, slope selection switches $S_1$ and $S_2$ can comprise voltage switches. It will be appreciated that while slope selection switches $S_1$ and $S_2$ are illustrated, additional slope selection switches and resistors can be included to provide for additional ramp paths.

Figure 4:
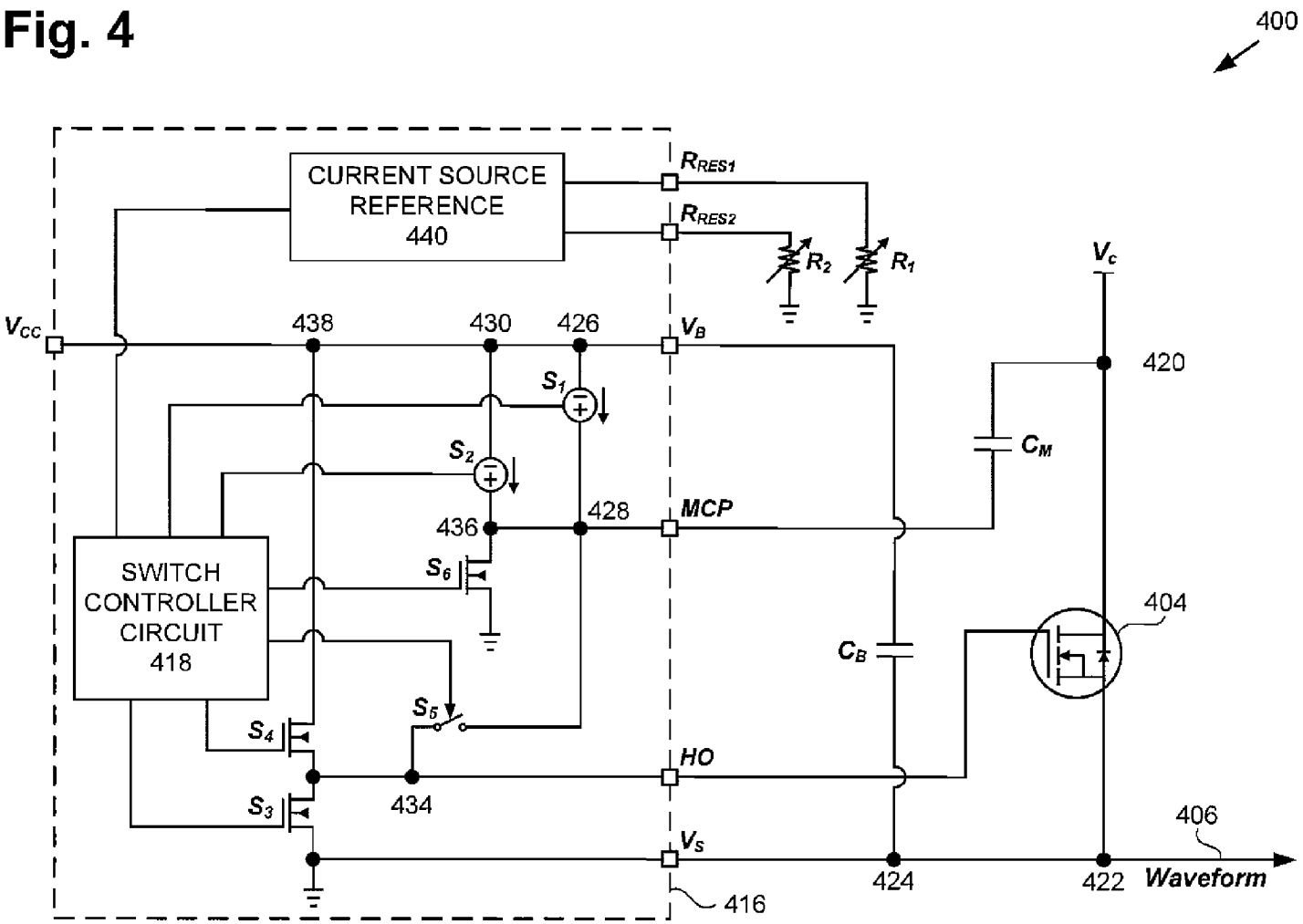
FIG. 4 illustrates an exemplary driver circuit for generating a reset pulse of an output waveform, according to one embodiment of the present invention.

In the present embodiment, each ramp path is configured to control the slope of the reset pulse by controlling current provided to gate G of transistor 204. For example, because each ramp path includes a different resistance, which can be selected using slope selection switches $S_1$ and $S_2$, current provided to gate G will vary depending on which ramp path is enabled. In other embodiments, any of the ramp paths can include a current source to provide the current to gate G. For example, FIG. 4 shows driver circuit 416, where each ramp path includes a current source as opposed to a voltage switch.

Driver circuit 216 also includes falling switch $S_3$ coupled to gate G of transistor 204 at node 234 and switch controller circuit 218 can selectively connect gate G of transistor 204 to ground using falling switch $S_3$, thereby selectively holding node 222 low. Thus, by selectively enabling the plurality of ramp paths and falling switch $S_3$ using switch controller circuit 218, waveform generator circuit 200 is configured to generate the reset pulse. For example, in the present embodiment, prior to generating the reset pulse, switch controller circuit 218 can enable falling switch $S_3$ to hold output waveform 206 low. Subsequently, switch controller circuit 218 can enable any of the ramp paths so that output waveform 206 will gradually rise with a given slope, where each ramp path is configured to control the slope. Switch controller circuit 218 can then enable falling switch $S_3$ to hold output waveform 206 low thereby generating the reset pulse.

It will be appreciated that, in the embodiment shown, falling switch $S_3$ should not be enabled at the same time as any of slope selection switches $S_1$ and $S_2$ so as to prevent shoot-through. Thus, in one embodiment, switch controller circuit 218 is configured to selectively enable the plurality of ramp paths and falling switch $S_3$ using an inverter so that falling switch $S_3$ is not enabled at the same time as any of slope selection switches $S_1$ and $S_2$. For example, gate drive signal 108 in FIG. 1 can comprise a square input waveform, where slope selection switches $S_1$ and $S_2$ and falling switch $S_3$ are controlled by an amplifier in switch controller circuit 218 receiving gate drive signal 108 with falling switch $S_3$ receiving the inverse of gate drive signal 108 as compared to any of slope selection switches $S_1$ and $S_2$ to generate the reset pulse. The slope of the reset pulse depends on which of slope selection switches $S_1$ and $S_2$ are enabled by gate drive signal 108. In one embodiment, switch controller circuit 218 can receive reference setting signal 110 that selects which of slope selection switches $S_1$ and $S_2$ are enabled by gate drive signal 108. Thus, reference setting signal 110 can select the slope of the reset pulse generated by waveform generator circuit 200.

Conventionally multiple slopes have been implemented in PDPs using separate general gate drivers for generating a particular reset pulse of a given slope. Each general gate driver is contained within a separate IC. However, driver circuit 200 can advantageously provide for multiple slopes of the reset pulse while being implemented as single IC. Furthermore, driver circuit 200 can include an integrated switch controller circuit 218 and falling switch $S_3$ for implementing the multiple slopes allowing for reduced components. Thus, driver circuit 200 can substantially reduce circuit cost and can consume less PCB space then conventional approaches.

Figure 3:
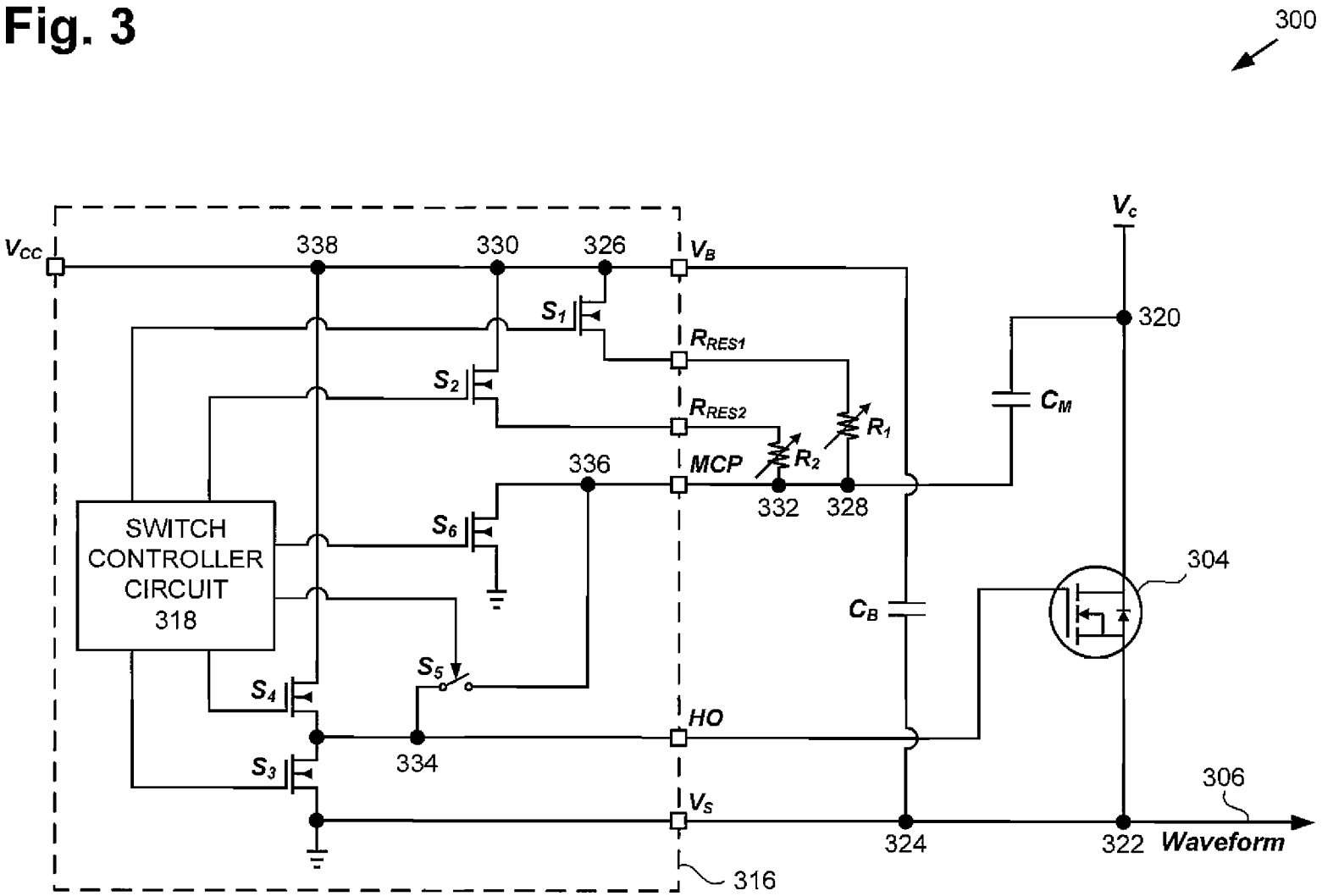
FIG. 3 illustrates an exemplary driver circuit for generating a reset pulse of an output waveform, according to one embodiment of the present invention.

FIG. 3 illustrates waveform generator circuit 300 corresponding to waveform generator circuit 100 in FIG. 1. Waveform generator circuit 300 can generate output waveform 306 corresponding to output waveform 106 in FIG. 1. Waveform generator circuit 300 includes transistor 304 corresponding to transistor 104 in FIG. 1. Waveform generator circuit 300 also includes driver circuit 316, reference resistors $R_1$ and $R_2$, bootstrap capacitor $C_B$ and miller capacitor $C_M$, which can correspond to driver circuit 216, reference resistors $R_1$ and $R_2$, bootstrap capacitor $C_B$ and miller capacitor $C_M$ in FIG. 2. Driver circuit 316 includes switch controller circuit 318 coupled to slope selection switches $S_1$ and $S_2$, falling switch $S_3$, rising switch $S_4$, and mode switches $S_5$ and $S_6$.

Driver circuit 316 is for generating a reset pulse and a sustain pulse in output waveform 306. In the present embodiment, driver circuit 316 has a reset mode where waveform generator circuit 300 generates output waveform 306 with a reset pulse and a sustain mode where waveform generator circuit 300 generates output waveform 306 with a sustain pulse. The reset and sustain modes can be selectively enabled by switch controller circuit 318, which can receive mode select signal 112 in FIG. 1 to select between the reset and sustain modes.

For example, switch controller circuit 318 can enable the reset mode by controlling mode switches $S_5$ and $S_6$. In the present embodiment, mode switch $S_5$ is enabled in the reset mode and mode switch $S_6$ is disabled in the reset mode. When mode switch $S_5$ is enabled, miller capacitor $C_M$ is connected to gate G of transistor 304 through nodes 336 and 334. When mode switch $S_6$ is disabled, miller capacitor $C_M$ is not connected to ground through node 336. Thus, during the reset mode, driver circuit 316 is configured to correspond to driver circuit 216 in FIG. 2. Therefore, the operation of waveform generator circuit 300 during the reset mode will not be described in detail. During the reset mode, switch controller circuit 318 can be used to generate the reset pulse by selectively enabling slope selection switches $S_1$ and $S_2$ and falling switch $S_3$ as described in FIG. 2, for example, using gate drive signal 108.

Switch controller circuit 318 can also enable the sustain mode by controlling mode switches $S_5$ and $S_6$. In the present embodiment, mode switch $S_5$ is disabled in the sustain mode and mode switch $S_6$ is enabled in the sustain mode. When mode switch $S_5$ is disabled, there is an open circuit between nodes 336 and 334. Thus, switch controller circuit 318 is configured to selectively disable miller capacitor $C_M$ to generate the sustain pulse. More particularly, switching controller 318 is configured to selectively disconnect miller capacitor $C_M$ from gate G of transistor 304 to generate the sustain pulse. When mode switch $S_6$ is enabled, miller capacitor $C_M$ is connected to ground through node 336. Thus, switching controller 318 is configured to selectively maintain charge on capacitor $C_M$ while a sustain pulse is generated. More particularly, switching controller 318 is configured to selectively connect miller capacitor $C_M$ between high supply voltage $V_C$ and ground while the sustain pulse is generated.

In the present embodiment, driver circuit 316 is configured to generate the sustain pulse by hard switching transistor 304. For example, during the sustain mode, switch controller circuit 318 is configured to selectively enable rising switch $S_4$ and falling switch $S_3$ to generate the sustain pulse of output waveform 306. As shown in FIG. 3, rising switch $S_4$ is connected to $V_{CC}$ supply pin through node 338 and to gate G of transistor 304 through node 334. It will be appreciated that, in the embodiment shown, falling switch $S_3$ should not be enabled at the same time as rising switch $S_4$ so as to prevent shoot-through. Thus, in one embodiment, switch controller circuit 318 is configured to selectively enable falling switch $S_3$ and rising switch $S_4$ using an inverter so that falling switch $S_3$ is not enabled at the same time as rising switch $S_4$. In one embodiment, switch controller circuit 318 can selectively enable falling switch $S_3$ and rising switch $S_4$ using gate drive signal 108, with falling switch $S_3$ receiving the inverse of gate drive signal 108 as compared to rising switch $S_4$.

As shown in FIG. 3, driver circuit 316 for generating the sustain pulse and the rest pulse can be included in a single IC as opposed to conventional circuits, which include a separate general gate driver IC for generating each pulse. Furthermore, in some embodiments, waveform generator circuit 300 can use transistor 304 for generating the reset pulse and the sustain pulse while conventional circuits use separate transistors. Thus, circuit cost and consumed PCB space can be further reduced.

FIG. 4 illustrates waveform generator circuit 400 corresponding to waveform generator circuit 300 in FIG. 3. Waveform generator circuit 400 can generate output waveform 406 corresponding to output waveform 306 in FIG. 3. Waveform generator circuit 400 includes transistor 404 corresponding to transistor 304 in FIG. 3. Waveform generator circuit 400 also includes driver circuit 416, reference resistors $R_1$ and $R_2$, bootstrap capacitor $C_B$ and miller capacitor $C_M$, which can correspond to driver circuit 316, reference resistors $R_1$ and $R_2$, bootstrap capacitor $C_B$ and miller capacitor $C_M$ in FIG. 3. Driver circuit 416 includes switch controller circuit 418 coupled to slope selection current sources $S_1$ and $S_2$, falling switch $S_3$, rising switch $S_4$, and mode switches $S_5$ and $S_6$. Waveform generator circuit 400 operates similar to waveform generator circuit 300 in FIG. 3, and thus will not be described in detail.

In the embodiment shown in FIG. 4, each of the ramp paths include a current source. As shown in FIG. 4, driver circuit 400 includes slope selection current sources $S_1$ and $S_2$, which are referenced using current source reference 440. Current source reference 440 is coupled to switch controller circuit 418 and slope selection current sources $S_1$ and $S_2$ are referenced respectively according to reference resistors $R_1$ and $R_2$ using current source reference 440.

Switch controller circuit 418 is configured to selectively enable a respective one of the ramp paths using slope selection current sources $S_1$ and $S_2$ as opposed to slope selection switch $S_1$ and $S_2$ described in FIG. 3. For example slope selection current source $S_1$ can be connected to $V_{CC}$ supply pin at node 426 and to gate G and miller capacitor $C_M$ through node 428 during reset mode. Thus, Switch controller circuit 418 can selectively provide current to gate G of transistor 404 using slope selection current source $S_1$. Similarly, slope selection current source $S_2$ can be connected to $V_{CC}$ supply pin at node 430 and to gate G and miller capacitor $C_M$ through node 436 during reset mode. Thus, switch controller circuit 418 can selectively provide current to gate G of transistor 404 using slope selection current source $S_1$. By selectively providing current from slope selection current sources $S_1$ and $S_2$, switch controller circuit 218 can selectively enable a ramp path.

In the present embodiment, each ramp path is configured to control the slope of the reset pulse by controlling current provided to gate G of transistor 404. In the embodiment shown in FIG. 4, each ramp path is provided using slope selection current sources $S_1$ and $S_2$. As opposed to the voltage switching embodiments shown in FIGS. 2 and 3, slope selection current sources $S_1$ and $S_2$ can reliably provide stable current at gate G of transistor 404 to generate the reset pulse. Thus, waveform generator circuit 400 can be provided without bootstrap capacitor $C_B$ while generating a stable reset pulse.

Thus, as discussed above, in the embodiments of FIGS. 1 through 4, the invention can provide for a driver circuit for generating a reset pulse of an output waveform. In various embodiments the driver circuit can also be for generating a sustain pulse. The driver circuit can provide for multiple slopes of the rest pulse while being implemented as single IC. The driver circuit can also provide for the sustain pulse while being implemented as single IC and in some embodiment can use the same transistor used to generate the reset pulse. Furthermore, the driver circuit can include an integrated switch controller circuit and falling switch for implementing the multiple slopes of the reset pulse and the sustain pulse. Thus, circuit cost and consumed PCB space can be substantially reduced.

From the above description of the invention it is manifest that various techniques can be used for implementing the concepts of the present invention without departing from its scope. Moreover, while the invention has been described with specific reference to certain embodiments, a person of ordinary skill in the art would appreciate that changes can be made in form and detail without departing from the spirit and the scope of the invention. Thus, the described embodiments are to be considered in all respects as illustrative and not restrictive. It should also be understood that the invention is not limited to the particular embodiments described herein but is capable of many rearrangements, modifications, and substitutions without departing from the scope of the invention.

The invention claimed is:

1. A driver circuit for generating a reset pulse of an output waveform, said driver circuit comprising:

a plurality of ramp paths, each ramp path having a different resistance to vary a current provided to a gate of a transistor to control a slope of said reset pulse such that said reset pulse has a desired slope amongst multiple selectable slopes;

a falling switch configured to selectively connect said gate of said transistor to ground, thereby selectively holding said output waveform low;

a mode switch configured to selectively connect said plurality of ramp paths to said gate and said falling switch;

a switch controller configured to selectively enable said plurality of ramp paths and said falling switch to generate said reset pulse, wherein selectively enabling said plurality of ramp paths selects said desired slope from said multiple selectable slopes.

2. The driver circuit of claim 1, wherein said switch controller selectively enables said plurality of ramp paths using voltage switches.

3. The driver circuit of claim 1, wherein each of said plurality of ramp paths includes a resistive element, said switch controller selectively connecting said resistive element to a low supply voltage.

4. The driver circuit of claim 1, wherein at least one of said plurality ramp paths comprises a current source.

5. The driver circuit of claim 1, wherein at least one of said ramp paths comprises a current source, and a current source reference for said current source coupled to said switch controller.

6. The driver circuit of claim 1, wherein said driver circuit drives said transistor to generate said reset pulse.

7. The driver circuit of claim 1, wherein said driver circuit drives said transistor to generate said reset pulse and a sustain pulse.

8. The driver circuit of claim 1, wherein said driver circuit drives said transistor to generate said reset pulse, said transistor coupled to a high voltage supply.

9. The driver circuit of claim 1, wherein said driver circuit drives said transistor to generate said reset pulse, said transistor coupled to a high voltage supply, a miller capacitor coupled between said high voltage supply and said gate of said transistor.

10. The driver circuit of claim 1, wherein said driver circuit further generates a sustain pulse.

11. The driver circuit of claim 1, comprising a rising switch, said switch controller selectively enabling said rising switch and said falling switch to generate a sustain pulse.

12. The driver circuit of claim 1, wherein said driver circuit drives said transistor to generate a sustain pulse.

13. The driver circuit of claim 1, wherein said driver circuit hard switches said transistor to generate a sustain pulse.

14. The driver circuit of claim 1, wherein a capacitor is used to generate said reset pulse, and wherein said switch controller selectively disables said capacitor to generate a sustain pulse.

15. The driver circuit of claim 1, wherein said driver circuit drives said transistor to generate said reset pulse, a capacitor coupled to said gate of said transistor, said switch controller selectively disconnecting said capacitor from said gate to generate a sustain pulse.

16. The driver circuit of claim 1, wherein a capacitor is used to generate said reset pulse, said switch controller selectively maintaining a charge on said capacitor when a sustain pulse is generated.

17. The driver circuit of claim 1, wherein a capacitor is used to generate said reset pulse, said switch controller selectively connecting said capacitor between a high supply voltage and ground when a sustain pulse is generated.

* * * * *